United States Patent [19]

Murasawa

[11] Patent Number: 4,568,176

[45] Date of Patent: Feb. 4, 1986

[54] METHOD FOR MAINTENANCE OF IMAGE FORMING DEVICE AND MEMBER THEREFOR

[75] Inventor: Yoshihiro Murasawa, Kawasaki, Japan

[73] Assignee: Canon Kabushiki Kaisha, Tokyo, Japan

[21] Appl. No.: 495,681

[22] Filed: May 18, 1983

[51] Int. Cl.[4] ..... G03G 21/00

[52] U.S. Cl. ..... 355/15; 430/125; 15/256.51; 15/1.5 R; 210/660; 210/681

[58] Field of Search ..... 355/15; 430/129; 15/256.51, 256.52, 1.5; 210/660, 681, 683, 685; 134/1, 6, 33

[56] References Cited

U.S. PATENT DOCUMENTS

| | | | |
|---|---|---|---|
| 3,793,018 | 2/1974 | Van Engeland et al. | 430/125 |
| 4,331,541 | 5/1982 | Akiyama et al. | 210/683 |
| 4,417,365 | 11/1983 | Murasaki | 355/15 |

OTHER PUBLICATIONS

"Ion Exchange"; Friedrich Helfferich, McGraw-Hill Book Company, Inc., 1962, p. 341.

*Primary Examiner*—A. T. Grimley
*Assistant Examiner*—David Warren
*Attorney, Agent, or Firm*—Fitzpatrick, Cella Harper & Scinto

[57] ABSTRACT

A method for maintenance of an image forming device having an image forming member which forms visible images from electrostatic latent images comprises maintaining the image forming ability of said image forming member by contacting the surface of said image forming member with an ion-exchange material.

19 Claims, 5 Drawing Figures

FIG. IA
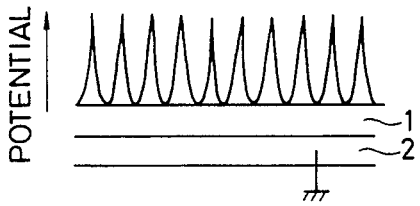
FIG. IB
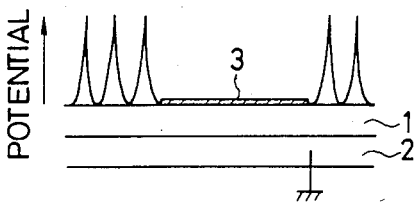
FIG. II
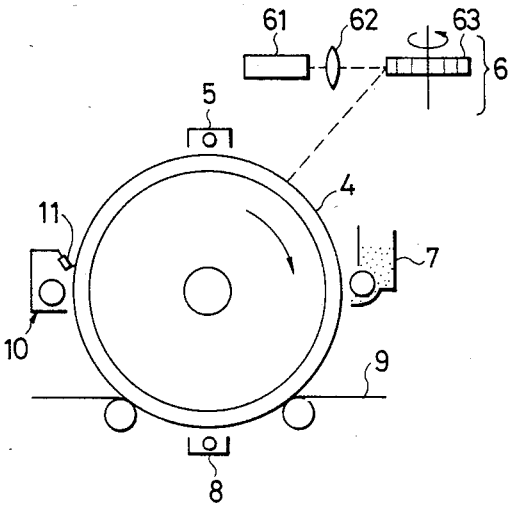
FIG. III
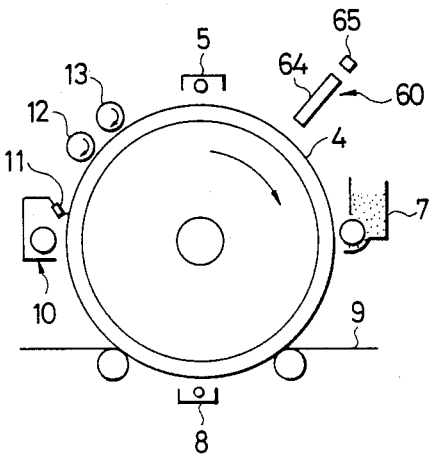
FIG. IV
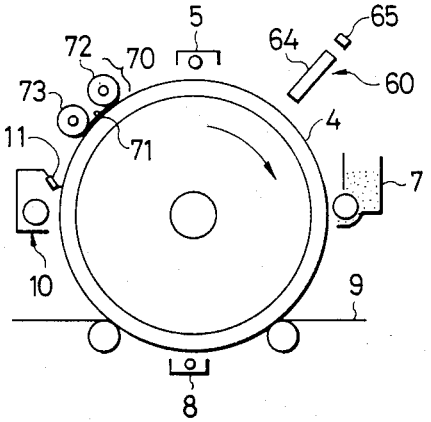

METHOD FOR MAINTENANCE OF IMAGE FORMING DEVICE AND MEMBER THEREFOR

BACKGROUND OF THE INVENTION

1. Field of the Invention

This invention relates to a method for maintenance of an image forming device such as an electrophotographic device, etc. particularly to a method for maintenance of the image forming ability of an image forming member.

2. Description of the Prior Art

An image forming device, for example, an electrophotographic copying device is a device which repeats the steps of charging, light-exosure, development, transfer, and cleaning with the use of a photosensitive drum coated with a photoconductive material such as Se, CdS, OPC, amorphous silicon, etc. to obtain copies of an original manuscript. In such a copying device, the step of charging a photosensitive member for image formation is generally practiced by imparting charges according to corona discharge, whereby various molecular species in the air are ionized at the same time by discharging and adsorbed onto the photosensitive member. Accordingly, when a copying machine is used over a long term, the ion species on the photosensitive member are bound with moistures in the air to form an ionic film on the photosensitive member. Such films are ionic in nature and therefore the surface electric resistance at the portion on which the film is formed is lowered, whereby simultaneously with exposure after charging, charges are escaped from the portion lowered in resistance. That is, at the portion along the film, no latent image potential sufficient for development can be retained to generate the phenomenon of the so called image smearing. This image smearing will frequently occur under highly humid environment, because the moisture in the air greatly participates therein.

In the prior art, as a countermeasure against the image smearing, there have been known the method in which the drum-shaped surface of a photosensitive member is polished with a polishing material, and the method in which fine powders of cerium oxide, etc. are added into a developer and polishing is performed with a cleaning blade. However, according to any of these methods, the ionic film is removed physically by polishing together with a photoconductive material, whereby the life of the photosensitive material is markedly lowered. Also, in the method incorporating cerium oxide in a developer, lowering of fixing as well as developing characteristics cannot be avoided. Further, when the photosensitive is made of a very hard material such as amorphous silicon, it is difficult to remove by polishing an ionic material from the surface of the drum-shaped a photosensitive member, and these methods were not effective.

SUMMARY OF THE INVENTION

An object of the present invention is to provide a novel method for preventing the surface of photosensitive members of image forming devices such as in electrophotography from formation of ionic films or removing the ionic films formed by overcoming such drawbacks of the prior art.

Another object of the present invention is to provide a method for maintenance of an image forming device which comprises photo-receiving layer having a layer comprising amorphous silicon, in particular, hydrogenated amorphous silicon.

Further object of the present invention is to provide a method for maintenance of an image forming device which removes ionic materials attached on the surface of an image forming member or prevents said surface from attachment of ionic materials by contacting an ion-exchange material with the surface of an image forming member of a device which forms visible images from electrostatic latent images.

Still further object of the present invention is to provide an electrophotographic system comprising the following:

- a drum-shaped photosensitive member;
- a light irradiating means;
- a charging means;
- a developing means; and
- a cleaning means, said cleaning means having a molded product comprising an ion-exchange material.

BRIEF DESCRIPTION OF THE DRAWINGS

FIGS. IA and IB show the results of measurements of the potentials in the latent images on photosensitive members.

FIGS. II through IV are examples of electrophotographic devices suitable for practicing the method of the present invention.

DETAILED DESCRIPTION OF THE PREFERRED EMBODIMENTS

Referring now to the accompanying drawings, the present invention is to be described in detail.

FIGS. IA and IB show the results of mesurements of the potentials in latent images on a photosensitive member which is a kind of an image forming member at the place where image smearing (the state in which image smears without formation of a normal image) is generated and at the place where no such image smearing occurred. The numeral 1 is a photosensitive layer comprising Se, CdS, OPC, amorphous silicon, etc., and 2 is a support comprising an electroconductive material such as aluminum. In FIG. IA, a desirable potential distribution is obtained and development of such a latent image will give a normal visible image. In contrast, in FIG. IB, an ionic film 3 is formed and the potential at said portion is low to give no normal latent image, which cannot be applied with a developing treatment to give a normal image because of image smearing. When this ionic film was analyzed qualitatively, it was found that it consisted primarily of nitrate ions and ammonium ions. Thus, the ionic film may be considered to be formed on the basis of decomposition of nitrogen molecules in the air through corona discharging.

FIG. II is an example of an electrophotographic copying device suitable for practicing one preferred embodiment of the method according to the present invention. The drum-shaped photosensitive member 4 receives charging uniformly on its surface by corona discharging of a charger 5. Then, by applying light irradiation corresponding to the image information to be recorded by means of a light irradiating means 6, a latent image is formed on the photosensitive member 4 and said latent image is visualized as the toner image by means of the developing means 7. As the next step, the toner image on the photosensitive member 4 is transferred onto the transfer material 9 under the action of the transferring charger 8. The surface of the photosensitive member 4 having completed transfer receives cleaning of the residual toner by means of the blade 11 constituting the cleaning means 10 to be returned to a clean surface, which is again thrown into the image treatment cycle. In the device as shown in FIG. II, the surface of the blade contacted with the photosensitive member 4 is formed to contain an ion-exchange material.

The cleaning member to be used in this embodiment comprises at least one of a cation exchange material and an anion exchange material, as in the above blade.

More specifically, a cleaning blade may be obtained according to, for example, the method in which a synthetic resin for molding of a blade having colloidally dispersed minute powders of an ion-exchange resin is molded into a desired shape, or a synthetic resin for molding of a blade having incorporated in itself ion-exchange groups is molded into a desired shape.

In the present invention, as the ion-exchange material, there may typically employed those comprising matrix resins of copolymers of styrene and divinylbenzene as preferable ones.

Typical examples of such ion-exchange material may include, in case of cation exchangers (cation exchange material), those having introduced sulfonic acid groups into this matrix resin commercially available under the trade name of Amberlite IR-120 (Rohm & Haas Co.), etc., those having introduced carboxylic acid groups commercially available under the trade name of Amberlite IRC-50 (Rohm & Haas Co.), and also those having incorporated phosphonic acid groups, phosphinic acid groups, etc.

In case of anion exchangers (anion exchange materials), there may be included those having introduced quaternary ammomium base into said matrix resin commersially available under the trade name of Amberlite IRA-900, IRA-400 (Rohm & Haas Co.), those having introduced tertiary amine groups commercially available under the trade names of Amberlite IRA-911, IRA-93 (Rohm & Haas Co.), and also those having introduced primary or secondary amine groups.

Among these ion-exchange materials, in the present invention, it is preferred to use those classified as the so-called strong-acid cation-exchange resins having introduced sulfonic acid groups and strong-base anion-exchange resins having introduced quaternary ammonium base.

In the method of the present invention, by contacting a member comprising at least one of such cation exchange materials and anion exchange materials with the surface of an image forming member, the ionic materials absorbed on the surface of said image forming member are removed through exchange reaction with $H^+$ of the sulfonic acid groups or $OH^-$ in the amine groups, thereby preventing formation of ionic films or removing ionic films. For example, according to the reactions shown below, ion species such as $NH_4^+$, $NO_3^-$, etc. are removed from the surface of the image forming member.

$$RSO_3^-H^+ + NH_4^+ \rightleftarrows RSO_3^-NH_4^+ + H^+$$

$$H^+OH^- \longrightarrow H_2O$$

The light irradiating means 6 constituting the copying device as shown in FIG. II comprises a semiconductor layer 6 including a light modulator, a f-$\theta$ lens 62, and a rotatory polygonal mirror (polygon) 63 capable of rotating at a high speed, and the light information emitted from the semiconductor laser 61 is irradiated on the surface of the photosensitive member 4 through the f-$\theta$ lens 62 and the rotatory polygonal mirror 63.

FIG. III shows another example of a copying device suitable for practicing the preferred embodiment of the method according to the present invention. The numerals 4 to 11 in this Figure are the same as in case of FIG. II. The numerals 12 and 13 are cleaning members provided only for the purpose of removal of ionic materials adhered on the surface of the photosensitive member 4 separately from removal of residual toners. Each of 12 and 13 is a roller comprising at least on its surface a cation exchange material or/and an anion exchange material, having a structure so as to scrape against the surface of the drum-shaped photosensitive member, and it is rotated in the same direction and at the same circumferential speed relative to the surface of the photosensitive member 4. In this embodiment, the cleaning members are made in the shape of rollers, whereby the contacting area with the photosensitive member 4 can be made larger and the contacted portion is moved through rotation to prevent lowering of the ion-exchanging capacity. Further, since they are provided as separate members from the cleaning blade 11 for removal of residual toners, there is no contamination of the cleaning blades 12, and 13 by toners, and repeated uses may be possible without reduction of ion-exchange capacity, if regeneration treatments of ion-exchange materials are performed.

The light irradiating means 60 in the copying device shown in FIG. III comprises a LED array 65 having a constitution in which a number of LED elements are arranged at certain pitches in an array and a convergent light-transmittor 64 (e.g. Selfoc, trade name) and the LED array is inputted with signals corresponding to the information to be recorded, each one of the corresponding LED elements is lighted in response to said signal.

In practicing of the present invention, in addition to the above embodiments, there may also be employed a dispersion of minute powders of an ion-exchange resin colloidally dispersed in an appropriate binder having film forming property which is molded into a sheet. Typical examples of such sheets are commercially available Nalfilm (trade name, produced by National Aluminum Co.) and Unilex (trade name, produced by Mitsubishi Yuka Co.). An embodiment using such a sheet as the cleaning member is shown in FIG. IV.

The same numerals indicate the same as in FIGS. II and III.

The cleaning means 70 in the electrophotographic copying device as shown in FIG. IV has one end of a sheet-shaped cleaning member 71 wound around the winding roller 72 mounted on a wind-up roller 73 so as to wind up the sheet-shaped cleaning member 71 at the used portion. The sheet-shaped cleaning member 71 is contacted with the surface of the photosensitive member 4 at between the winding roller 72 and the wind-up roller 73 and performs cleaning of said surface. The wind-up direction of the wind-up roller 73 may desirably be opposite to the rotational direction of the photosensitive member 4.

In this embodiment, the contact area between the surface of the photosensitive member 4 and the cleaning member 71 can be made greater, and at the same time the cleaning member at the used portion can be wound up by means of the wind-up roller 73, whereby always the cleaning member at the new portion can be conveniently supplied.

The shape and the position to be placed of the cleaning member to be used in the present invention is not limited to the above embodiments, but there may be employed various modes such as fibrous ion-exchange materials or fibrous materials impregnated with an ion-exchange material which are formed into brushes.

In any of the embodiments as shown in FIGS. II to IV, as one step in the image forming process, reference is made to an example wherein the surface of a photosensitive member which is one of image forming members is contacted with a cleaning member comprising an ion-exchange material. Such a contact of a cleaning member with the surface of a photosensitive member may be performed for each image forming process, or, before lowering of image forming ability of a photosensitive member exceeds a tolerable range, it may be performed at definite or indefinite intervals in connection with or independently of the imave forming process.

Even when lowering of image forming ability of the photosensitive member as an image forming member may exceed a tolerable range, the image forming ability of the photosensitive member may be attempted to be repaired by allowing the cleaning member to contact with the surface of the photosensitive member within the range so that the image ability may be restored to the original state or to the state at which image formation may be possible at a practical level.

Ion-exchange material may be imparted to an image forming member by carrying ion-exchange material on an appropriate member such as a cleaning member as described above and allowing said member to contact with the surface of an image forming member. In addition, it is also possible to prepare a member of a desired shape from an ion-exchange material itself and contact said member with the surface of an image forming member through rubbing, etc. By application of the method of the present invention to an image forming device such as an electrophotographic device, prevention of generation of image smearing and restoration of the image forming ability lowered as the result of image smearing generation can be attempted, whereby a stable use can be rendered possible for a long term.

The present invention is effectively applied to conventional electrophotographic image forming member such as Se type photosensitive member, ZnO-resin binder type photosensitive member, CdS-resin binder type photosensitive member, photosensitive member using organic semiconductive material, or photosensitive member provided with a protective layer or an electrically insulating layer on a photoconductive layer. In particular, the objects of the present invention are effectively achieved by applying to an image forming member which comprises a photo-receiving layer having a layer comprising amorphous silicon, in particular, hydrogenated amorphous silicon.

Such image forming member and a method for the preparation thereof are described in, for example, U.S. Pat. Nos. 4,265,991, 4,359,512, 4,359,514, 4,377,628, and 4,378,417, U.K. Patent Application Laid-open No. 2018446 specifications, and the like.

The present invention is described in more detail by referring to the following Examples.

EXAMPLE 1

An urethane rubber blade was prepared by molding of a dispersion at a weight ratio of 1:1 of a cation exchange resing having introduced sulfonic acid groups into a styrene-divinylbenzene copolymer (trade name: Amberlite 200) and an anion exchange resin having introduced amino groups into a styrene-divinylbenzene copolymer (trade name: Amberlite IRA-900). This blade was set in an electrophotographic device of which photosensitive member comprises amorphous silicon as shown in FIG. II, and the copying test was conducted under an environment of 35° C. and a relative humidity of 85%. As the result, no image smearing occurred after 20,000 sheets of durability test and the image quality substantially the same as the initial stage could be obtained. For comparative purpose, when the test was repeated under the same conditions using the deVice equipped with a blade without application of any treatment, image smearing generated from about 2,000 sheets.

EXAMPLE 2

One pair of silicon sponge rollers was prepared. In one of them, a cationic exchange resin having introduced sulfonic acid groups into a styrene-divinylbenzene copolymer (trade name: Amberlite 200) was dispersed; in another of them a styrene-divinylpenzene copolymer was dispersed. This pair was set as rollers 12 and 13 in an electrophotographic device comprising a photosensitive member of amorphous silicon as shown in FIG. III. Another pair of silicon sponge rollers was prepared. In one of them, an anion exchange resin having introduced amino groups into a styrene-divinylbenzene copolymer (trade name: Amberlite IRA-900) was dispersed; in another of them a styrene-divinylbenzene copolymer was dispersed. This pair was set as rollers 12 and 13 in an electrophotographic device comprising a photosensitive member of amorphous silicon as shown in FIG. III. The copying test was practiced under an environment of 35° C. and a relative humidity of 85%. As the result, no image smearing occurred after 40,000 sheets of copying.

When these rollers were dismantled and the cation exchange roller was subjected to the regeneration treatment with a hydrochloric acid solution and the anion exchange roller with a sodium hydroxide solution, and again mounted on the electrophotographic device, followed further by the copying test of 40,000 sheets. As the result, no image smearing occurred and the image quality was maintained as good as at the start-up of copying.

EXAMPLE 3

Sheet rollers were prepared with "Unilex" (Mitsubishi Yuka Co.) and these rollers were assembled in an electrophotographic device comprising a photosensitive member of amorphous silicon as shown in FIG. IV. The wind-up speed of the sheet was set at about 1/20 of the circumferential speed of the drum. Under an environment of 35° C. and a relative humidity of 85%, the copying test was practiced. As the result, there was no problem during copying of 40,000 sheets.

What I claim is:

1. A method for maintenance of an image forming device having an image forming member which forms visible images from electrostatic latent images, which comprises maintaining the image forming ability of said image forming member by contacting the surface of said image forming member with an ion-exchange material.

2. The method for maintaining an image forming device according to claim 1 including contacting the surface of the image-forming member with a molded cleaning member comprising a resin matrix having ion-exchange groups introduced therein.

3. The method for maintaining an image forming device according to claim 2 including contacting the surface with the cleaning member in a sheet form.

4. The method for maintaining an image forming device according to claim 2 including contacting the surface with the cleaning member in a roller form.

5. The method for maintaining an image forming device according to claim 2 including contacting the surface with the cleaning member in a blade form.

6. The method for maintaining an image forming device according to claim 1, including contacting said surface with a strong-acid cation-exchange material.

7. The method for maintaining an image forming device according to claim 1, including contacting said surface with a strong-base anion-exchange material.

8. An electrophotographic system comprising the following:

a drum-shaped photosensitive member;

a light irradiating means;

a charging means;

developing means; and a drum cleaning means, said drum cleaning means having a molded product comprising an ion-exchange material.

9. An electrophotographic system according to claim 8, wherein the molded product comprises a matrix resin having introduced ion-exchange groups.

10. An electrophotographic system according to claim 8, wherein the molded product comprises a dispersion having an ion-exchange material dispersed colloidally in a resin binder.

11. An electrophotographic system according to claim 8, wherein the ion-exchange material is a strong-acid cation-exchange resin.

12. An electrophotographic system according to claim 8, wherein the ion-exchange material is a strong-base anion-exchange resin.

13. An electrophotographic system according to claim 8, wherein the molded product is in the form of a blade.

14. An electrophotographic system according to claim 8, wherein the molded product is in the form of a roller.

15. An electrophotographic system according to claim 8, wherein the molded product is in the form of a sheet.

16. An electrophotographic system according to claim 8, wherein the drum-shaped photosensitive member comprises a layer containing amorphous silicon.

17. An electrophotographic system according to claim 16 wherein said amorphous silicon is hydrogenated amorphous silicon.

18. A cleaning member for removing ionic materials attached the surface of an image forming member comprising a molded product having a portion which is adapted to contact the surface of said image forming member and which contains an ion-exchange material at least in said portion which contacts the image forming member for removing attached ionic materials.

19. A method for maintaining an image forming device having an image forming member which has a photosensitive layer comprising amorphous silicon and which member forms visible images from electrostatic latent images, comprising: maintaining the image forming ability of said image forming member by contacting the surface of said image forming member with an ion-exchange material.

* * * * *

UNITED STATES PATENT AND TRADEMARK OFFICE

CERTIFICATE OF CORRECTION

PATENT NO. : 4,568,176

DATED : February 4, 1986

INVENTOR(S) : Yoshihiro Murasa

It is certified that error appears in the above-identified patent and that said Letters Patent is hereby corrected as shown below:

On cover page insert --[30] Foreign Application Priority Data
May 24, 1982 [JP] Japan .....57-86456--.

Column 1, line 53, "photosensitive is" should be --photosensitive member is--.

Column 1, line 55, "drum-shaped a photosensitive" should be --drum-shaped photosensitive--.

Column 2, line 34, "mesurements" should be --measurements--.

Column 3, line 20, "may typically" should be --may be typically--.

Column 3, line 34, "ammomium" should be --ammonium--.

Column 3, line 34-35, "commersially" should be --commercially--.

Column 4, line 68, "whereby always the" should be --whereby the--.

Column 5, line 1, "can be" should be --can always be--.

Column 5, line 20, "imave" should be --image--.

Column 5, line 27, "image ability" should be --image forming ability--.

Column 5, line 46, "member" should be --members--.

Column 6, line 15, "deVice" should be --device--.

Signed and Sealed this

Sixteenth Day of December, 1986

*Attest:*

DONALD J. QUIGG

*Attesting Officer*

*Commissioner of Patents and Trademarks*